US008875629B2

(12) United States Patent
Rondon et al.

(10) Patent No.: US 8,875,629 B2
(45) Date of Patent: Nov. 4, 2014

(54) ABLATION-TYPE LITHOGRAPHIC IMAGING WITH ENHANCED DEBRIS REMOVAL

(75) Inventors: Sonia Rondon, Nashua, NH (US); Kevin Ray, Windham, NH (US)

(73) Assignee: Presstek, Inc., Hudson, NH (US)

( * ) Notice: Subject to any disclaimer, the term of this patent is extended or adjusted under 35 U.S.C. 154(b) by 1104 days.

(21) Appl. No.: 12/757,385

(22) Filed: Apr. 9, 2010

(65) Prior Publication Data

US 2011/0249250 A1 Oct. 13, 2011

(51) Int. Cl.
*B41C 1/10* (2006.01)
*B41N 3/00* (2006.01)
*B41N 1/00* (2006.01)

(52) U.S. Cl.
CPC ..... *B41C 1/1033* (2013.01); *B41N 1/003* (2013.01); *B41N 3/006* (2013.01)
USPC ..... 101/451; 101/457; 101/467

(58) Field of Classification Search
CPC ..... B41C 1/1033
USPC ..... 101/450.1, 454, 453
See application file for complete search history.

(56) References Cited

U.S. PATENT DOCUMENTS

| | | | | |
|---|---|---|---|---|
| 4,086,853 | A * | 5/1978 | Figov et al. | 101/463.1 |
| 4,255,196 | A * | 3/1981 | Emmons et al. | 106/31.66 |
| 4,963,472 | A | 10/1990 | Schlosser et al. | |
| 5,339,737 | A | 8/1994 | Lewis et al. | |
| 5,487,338 | A | 1/1996 | Lewis et al. | |
| 5,632,204 | A | 5/1997 | Lewis | |
| 5,704,291 | A | 1/1998 | Lewis | |
| 6,055,906 | A | 5/2000 | Lewis | |
| 6,187,380 | B1 * | 2/2001 | Hallman et al. | 427/261 |
| 6,410,208 | B1 * | 6/2002 | Teng | 430/302 |
| 6,613,496 | B1 * | 9/2003 | Inno et al. | 430/303 |
| 6,935,237 | B2 * | 8/2005 | Higashi | 101/463.1 |
| 7,291,438 | B2 * | 11/2007 | Sakurai et al. | 430/175 |
| 2001/0026902 | A1 | 10/2001 | Hirano et al. | |
| 2002/0020832 | A1 * | 2/2002 | Oka et al. | 252/500 |
| 2002/0081529 | A1 | 6/2002 | Sonokawa | |
| 2003/0175619 | A1 | 9/2003 | Iihara et al. | |
| 2004/0005514 | A1 | 1/2004 | Saraiya et al. | |
| 2005/0142480 | A1 * | 6/2005 | Bode et al. | 430/270.1 |
| 2007/0101886 | A1 * | 5/2007 | Teng | 101/450.1 |
| 2009/0253069 | A1 | 10/2009 | Melamed et al. | |
| 2009/0305162 | A1 | 12/2009 | Melamed et al. | |

FOREIGN PATENT DOCUMENTS

| | | |
|---|---|---|
| EP | 1031413 A2 | 8/2000 |
| WO | WO-0108885 | 2/2001 |

* cited by examiner

*Primary Examiner* — Joshua D Zimmerman
(74) *Attorney, Agent, or Firm* — Bingham McCutchen LLP

(57) ABSTRACT

Sequentially subjecting an imaged ablation-type printing member having a silicone topmost layer to, first, a cleaning liquid that is not a solvent for silicone, followed by subjecting to a second cleaning liquid that is a silicone solvent, conditions the printing member for subsequent printing with high-solids inks.

23 Claims, No Drawings

ABLATION-TYPE LITHOGRAPHIC IMAGING WITH ENHANCED DEBRIS REMOVAL

BACKGROUND OF THE INVENTION

In offset lithography, a printable image is present on a printing member as a pattern of ink-accepting (oleophilic) and ink-rejecting (oleophobic) surface areas. Once applied to these areas, ink can be efficiently transferred to a recording medium in the imagewise pattern with substantial fidelity. Dry printing systems utilize printing members whose ink-repellent portions are sufficiently phobic to ink as to permit its direct application. In a wet lithographic system, the non-image areas are hydrophilic, and the necessary ink-repellency is provided by an initial application of a dampening fluid to the plate prior to inking. The dampening fluid prevents ink from adhering to the non-image areas, but does not affect the oleophilic character of the image areas. Ink applied uniformly to the printing member is transferred to the recording medium only in the imagewise pattern. Typically, the printing member first makes contact with a compliant intermediate surface called a blanket cylinder which, in turn, applies the image to the paper or other recording medium. In typical sheet-fed press systems, the recording medium is pinned to an impression cylinder, which brings it into contact with the blanket cylinder.

To circumvent the cumbersome photographic development, plate-mounting, and plate-registration operations that typify traditional printing technologies, practitioners have developed electronic alternatives that store the imagewise pattern in digital form and impress the pattern directly onto the plate. Plate-imaging devices amenable to computer control include various forms of lasers.

Current laser-based lithographic systems frequently rely on removal of an energy-absorbing layer from the lithographic plate to create an image. Exposure to laser radiation may, for example, cause ablation—i.e., catastrophic overheating—of the ablated layer in order to facilitate its removal. Because ablation produces airborne debris, ablation-type plates must be designed with imaging byproducts in mind; for example, the plate may be designed so as to trap ablation debris between layers, at least one of which is not removed until after imaging is complete.

Dry plates, which utilize an oleophobic topmost layer of fluoropolymer or, more commonly, silicone (polydiorganosiloxane), exhibit excellent debris-trapping properties because the topmost layer is tough and rubbery; ablation debris generated thereunder remains confined as the silicone or fluoropolymer does not itself ablate. Where imaged, the underlying layer is destroyed or de-anchored from the topmost layer. A common three-layer plate, for example, is made ready for press use by image-wise exposure to imaging (e.g., infrared or "IR") radiation that causes ablation of all or part of the central layer, leaving the topmost layer de-anchored in the exposed areas. Subsequently, the de-anchored overlying layer and the central layer are removed (at least partially) by a post-imaging cleaning process—e.g., rubbing of the plate with or without a cleaning liquid—to reveal the third layer (typically an oleophilic polymer, such as polyester).

Ablation debris remaining in the newly formed gap between layers includes pyrolytic remnants of the imaging layer, as well as fragments of the overlying and underlying layers. Although these layers are not ablated in the bulk sense—i.e., ablation is limited to the interfacial areas near the imaging layer—they do shed material in response to the heat generated by pyrolysis of the imaging layer. Silicone debris can be particularly resistant to removal. In many printing systems, application of the ink itself (during the print "make-ready" process, which involves several preliminary cycles of inking and printing) removes any debris that persisted through the cleaning step.

This is possible, however, only if the ink contains a solvent capable of entraining or at least partially dissolving the debris. Many inks in current use are solventless inks, such as those curable by ultraviolet ("UV") radiation. UV-curable inks are considered "100% solid systems" in that they contain only pigment and acrylic monomers; although they are not dry (having, instead, a paste-like viscosity), they do not contain solvents. A typical UV-curable waterless ink may consist of blue pigment 16%, carbon black 4%, epoxy acrylate resin 30%, fatty acid modified epoxy acrylate 25%, monomer viscosity modifier 8%, benzophenone initiator 8%, co-initiator 3%, photosynergist 4% and wax 2%.

Such inks, unfortunately, do not contribute to plate cleaning. A press operator will complain of "poor ink-up": the exposed regions of the plate are slow to accept ink due to remnant silicone. Thus, there is a need for a cleaning regimen that accommodates solventless inks, but which does not impose undesirable environmental consequences, inconvenience or expense.

SUMMARY OF THE INVENTION

It has been found that sequentially subjecting an imaged ablation-type printing member having a silicone topmost layer to, first, a cleaning liquid that is not a solvent for silicone, followed by subjecting to a second cleaning liquid that is a silicone solvent, conditions the printing member for subsequent printing with high-solids inks. Following these steps, the printing member exhibits good "ink-up" and can print following normal "make-ready" procedures (i.e., consumption of 40 or fewer sheets). This is in contrast to known techniques that utilize a single cleaning fluid containing both aqueous and solvent components.

The first cleaning liquid is typically aqueous in nature, but the important feature is that it is free of organic solvent. For example, the liquid may consist essentially of water, e.g., it may be plain tap water. The aqueous liquid may be warmed to a temperature of 32-50° C.

The second cleaning liquid may be pure solvent, but to minimize both cost and environmental impact, it may include both aqueous and organic components—i.e., a hydrocarbon solvent fraction no greater than necessary to effect removal of silicone and carbon debris. In some embodiments, the solvent fraction represents as little as 5 wt % of the second cleaning liquid. Typically it represents no more than 20 wt % of the second cleaning liquid.

Accordingly, in a first aspect, the invention relates to a method of printing with an ablation-type printing member having a silicone topmost layer. A blank printing member (or portion thereof) is exposed to ablative radiation to create thereon an image region including ablation debris. The printing member is then subjected to a first cleaning liquid that is not a solvent for silicone to remove a portion of the ablation debris. Thereafter, the printing member is subjected to a second cleaning liquid that comprises or consists essentially of a solvent for silicone. The result is an imagewise lithographic pattern on the printing member. Following the removal step, a high-solids ink is applied to the printing member, and the applied ink is transferred from the printing member to a recording medium. The steps of applying and transferring ink may be repeated as necessary (but typically fewer than 40 times) to complete cleaning of the printing member before commencing printing, whereupon the ink adheres only to imaged portions of the printing member. The applied ink may be a high-solids ink, e.g., a 100%-solids ink such as a UV-curable ink. In such cases, the ink typically consists essentially of pigment and acrylic monomers.

The organic component (i.e., the solvent for silicone) may comprise or consist essentially of an alcohol, e.g., a glycol ether (such as 2-butoxyethanol, also known as butyl cellosolve). In other embodiments, the organic component comprises or consists essentially of an animal or vegetable oil. More generally, the organic component may comprise or consist essentially of a hydrocarbon solvent.

In another aspect, the invention relates to a method of imaging an ablation-type printing member having a silicone topmost layer. A blank printing member (or portion thereof) is exposed to ablative radiation to create thereon an image region including ablation debris. The printing member is then subjected to a first cleaning liquid that is not a solvent for silicone to remove a portion of the ablation debris. Thereafter, the printing member is subjected to a second cleaning liquid that comprises or consists essentially of a solvent for silicone. The result is an imagewise lithographic pattern on the printing member. Following the removal step, a high-solids ink may be applied to the printing member and transferred to a recording medium. The steps of applying and transferring ink may be repeated as necessary.

It should be stressed that, as used herein, the term "plate" or "member" refers to any type of printing member or surface capable of recording an image defined by regions exhibiting differential affinities for ink and/or fountain solution. Suitable configurations include the traditional planar or curved lithographic plates that are mounted on the plate cylinder of a printing press, but can also include seamless cylinders (e.g., the roll surface of a plate cylinder), an endless belt, or other arrangement.

The term "high-solids ink" means an ink that is substantially free of solvent, e.g., an ink containing only pigment and curable monomeric components.

"Ablation" of a layer means either rapid phase transformation (e.g., vaporization) or catastrophic thermal overload, resulting in uniform layer decomposition. Typically, decomposition products are primarily gaseous. Optimal ablation involves substantially complete thermal decomposition (or pyrolysis) with limited melting or formation of solid decomposition products.

The term "substantially" means±10% (e.g., by weight or by volume), and in some embodiments, ±5%. The term "consists essentially of" means excluding other materials that contribute to function. For example, a cleaning fluid having a solvent for silicone that consists essentially of alcohol contains no other material functioning as a solvent for silicone, although it may contain ingredients that do not contribute to this function.

DETAILED DESCRIPTION

Ablation-type printing members having silicone topmost layers are well-known and described, for example, in U.S. Pat. No. 5,339,737 (the entire disclosure of which is hereby incorporated by reference). A representative negative-working printing member having three operative layers includes an oleophilic (e.g., polyester) substrate, an IR-ablatable imaging layer that may be metal or polymeric, and a topmost silicone layer. Imaging of the printing member by exposure to IR radiation results in imagewise ablation of the imaging layer and consequent de-anchoring of the silicone top layer. In a two-layer system, the silicone layer directly overlies a polymeric substrate, only a small thickness of which is ablated by the laser beam. The result, once again, is de-anchorage of the silicone topmost layer, which is removed by cleaning.

Silicone polymers are based on the repeating diorganosiloxane unit $(R_2SiO)_n$, where R is an organic radical or hydrogen and n denotes the number of units in the polymer chain. Fluorosilicone polymers are a particular type of silicone polymer wherein at least a portion of the R groups contain one or more fluorine atoms. The physical properties of a particular silicone polymer depend upon the length of its polymer chain, the nature of its R groups, and the terminal groups on the end of its polymer chain. Any suitable silicone polymer known in the art may be incorporated into or used for the surface layer.

Silicone polymers are typically prepared by cross-linking (or "curing") diorganosiloxane units to form polymer chains. The resulting silicone polymers can be linear or branched. A number of curing techniques are well known in the art, including condensation curing, addition curing, moisture curing. In addition, silicone polymers can include one or more additives, such as adhesion modifiers, rheology modifiers, colorants, and radiation-absorbing pigments, for example. Other options include silicone acrylate monomers, i.e., modified silicone molecules that incorporate "free radical" reactive acrylate groups or "cationic acid" reactive epoxy groups along and/or at the ends of the silicone polymer backbone. These are cured by exposure to UV and electron radiation sources. This type of silicone polymer can also include additives such as adhesion promoters, acrylate diluents, and multifunctional acrylate monomer to promote abrasion resistance, for example.

Imaging and cleaning in accordance with the present invention may take place directly on a press, or on a platemaker. In general, the imaging apparatus will include at least one laser device that emits in the region of maximum plate responsiveness, i.e., whose $\lambda_{max}$ closely approximates the wavelength region where the plate absorbs most strongly. Specifications for lasers that emit in the near-IR region are fully described in U.S. Pat. No. Re. 33,512 ("the '512 patent") and U.S. Pat. No. 5,385,092 ("the '092 patent"), the entire disclosures of which are hereby incorporated by reference. Lasers emitting in other regions of the electromagnetic spectrum are well-known to those skilled in the art.

Suitable imaging configurations are also set forth in detail in the '512 and '092 patents. Briefly, laser output can be provided directly to the plate surface via lenses or other beam-guiding components, or transmitted to the surface of a blank printing plate from a remotely sited laser using a fiber-optic cable. A controller and associated positioning hardware maintain the beam output at a precise orientation with respect to the plate surface, scan the output over the surface, and activate the laser at positions adjacent selected points or areas of the plate. The controller responds to incoming image signals corresponding to the original document or picture being copied onto the plate to produce a precise negative or positive image of that original. The image signals are stored as a bitmap data file on a computer. Such files may be generated by a raster image processor ("RIP") or other suitable means. For example, a RIP can accept input data in page-description language, which defines all of the features required to be transferred onto the printing plate, or as a combination of page-description language and one or more image data files. The bitmaps are constructed to define the hue of the color as well as screen frequencies and angles.

Other imaging systems, such as those involving light valving and similar arrangements, can also be employed; see, e.g., U.S. Pat. Nos. 4,577,932; 5,517,359; 5,802,034; and 5,861,992, the entire disclosures of which are hereby incorporated by reference. Moreover, it should also be noted that image dots may be applied in an adjacent or in an overlapping fashion.

The imaging apparatus can operate on its own, functioning solely as a platemaker, or can be incorporated directly into a lithographic printing press. In the latter case, printing may commence immediately after cleaning as described herein. The imaging apparatus can be configured as a flatbed recorder or as a drum recorder, with the lithographic plate blank mounted to the interior or exterior cylindrical surface of the drum. Obviously, the exterior drum design is more appropriate to use in situ, on a lithographic press, in which case the print cylinder itself constitutes the drum component of the recorder or plotter.

In the drum configuration, the requisite relative motion between the laser beam and the plate is achieved by rotating the drum (and the plate mounted thereon) about its axis and moving the beam parallel to the rotation axis, thereby scanning the plate circumferentially so the image "grows" in the axial direction. Alternatively, the beam can move parallel to the drum axis and, after each pass across the plate, increment angularly so that the image on the plate "grows" circumferentially. In both cases, after a complete scan by the beam, an image corresponding (positively or negatively) to the original document or picture will have been applied to the surface of the plate. In the flatbed configuration, the beam is drawn across either axis of the plate, and is indexed along the other axis after each pass. Of course, the requisite relative motion between the beam and the plate may be produced by movement of the plate rather than (or in addition to) movement of the beam.

Examples of useful imaging devices include models of the MAGNUS and TRENDSETTER imagesetters (available from Eastman Kodak Company) that utilize laser diodes emitting near-IR radiation at a wavelength of about 830 nm. Other suitable exposure units include the CRESCENT 42T Platesetter (operating at a wavelength of 1064 nm, available from Gerber Scientific, Chicago, Ill.) and the SCREEN PLATERITE 4300 series or 8600 series plate-setter (available from Screen, Chicago, Ill.).

Following imaging, the printing member is subjected to the action of a first cleaning liquid that is not a solvent for silicone to remove a portion of the ablation debris. Thereafter, the printing member is subjected to a second cleaning liquid that comprises or consists essentially of a solvent for silicone. Herein, a "solvent for silicone" means one or more liquids that can entrain or at least partially dissolve silicone debris with sufficient affinity to detectably remove at least a fraction of the debris from a surface to which it is bonded chemically or mechanically, thereby improving printing. The printing member can then accept a high-solids ink, which is transferred to a recording medium in accordance with the lithographic image. A solvent for silicone may also or alternatively mask, i.e., cover up the remnant silicone, allowing the ink, when applied, to pull it away. The steps of applying and transferring ink may be repeated as necessary to ready the plate for actual printing.

The cleaning liquids may be applied manually, using a cloth and/or brush, or mechanically using commercial plate-cleaning equipment. For example, many platemakers contain internal rotary scrub rollers that clean the plate following imaging.

The first cleaning liquid is typically plain water which, when applied with abrasive action (imparted, for example, by cleaner rollers), removes loosened silicone fragments (solid debris) left in the exposed areas of the plate after imaging. It is believed that water has two main functions: it acts as a lubricant to prevent damage to the plate due to aggressive mechanical action, and also helps to collect or gather the solid silicone debris left on the plate. Typically, this first cleaning step removes the debris that is visually (and microscopically) evident, which may represent more than 85% (or even 95% or 98% or more) of the total imaging debris. The first cleaning liquid may be warmed, e.g., to 32° C. to 50° C.

The second cleaning step is performed with a liquid including or consisting essentially of a solvent for silicone. Typically, the second cleaning liquid is unheated (and may be cold in some implementations). In various embodiments, the second cleaning liquid is a mixture of water and an organic liquid, and water may make up at least 80 wt %, or in some cases 95 wt % or more, of the mixture. The second cleaning step may also be performed manually or mechanically. The solvent component of the second cleaning liquid removes at least a portion of the remaining silicone residue that is embedded within or strongly bonded to the image areas of the plate surface. This resilient residue may represent less than 2% of the total silicone debris, but it is enough to affect the inking behavior of the plate. The residue often is not visually evident and may consist of decomposition products of the silicone polymer generated by the large amount of heat generated during imaging.

Thus, while the second cleaning liquid may be pure solvent, it may alternatively include both aqueous and organic components, with a solvent fraction no greater than necessary to effect removal of silicone and carbon debris. In some embodiments, the solvent fraction represents as little as 5 wt % of the second cleaning liquid. For example, the solvent fraction may comprise or consist essentially of an alcohol, e.g., a glycol ether (such as butyl cellosolve). In various embodiments, the alcohol represents ~6% of the composition, which may include a surfactant, defoamer and/or D-limonene. In various embodiments, the solvent fraction may include or consist essentially of emulsified D-limonene, compositions in which D-limonene is combined with butyl cellusolve and a surfactant, or emulsified oils. More generally, the organic component may comprise or consist essentially of a hydrocarbon solvent, e.g., hexane, toluene, solvent naphtha, or a cyclic terpene.

In other embodiments, the organic component may represent the entirety of the second cleaning liquid, comprising or consisting essentially of an animal or vegetable oil. But the oil may, in other embodiments, be combined with water to form an emulsion, which may be stabilized with a surfactant or emulsifier; the emulsion may also contain a defoamer.

In general, the organic component of the second cleaning liquid has either no or low volatile organic compound (VOC) material(s). As used herein, the term "VOC" means an organic compound having a boiling point less than 250° C. at standard atmospheric pressure, and "low VOC" means that the VOC represents 0.3% to 7.99% of the cleaning liquid by weight.

In cases where the solvent fraction includes or consists essentially of an alcohol, the alcohol may be the reaction products of phenol with ethylene oxide. In cases where the second cleaning liquid includes water or other aqueous liquid, water-miscible solvents that may be present include, but are not limited to, the reaction products of phenol with ethylene oxide and propylene oxide such as ethylene glycol phenyl ether (phenoxyethanol), esters of ethylene glycol and of propylene glycol with acids having six or fewer carbon atoms, and ethers of ethylene glycol, diethylene glycol, and of propylene glycol with alkyl groups having six or fewer carbon atoms, such as 2-ethoxyethanol and 2-butoxyethanol.

The aqueous liquid of the second cleaning liquid may include one or more surfactants. Useful anionic surfactants include those with carboxylic acid, sulfonic acid, or phosphonic acid groups (or salts thereof). Anionic surfactants having sulfonic acid (or salts thereof) groups are particularly useful. For example, anionic surfactants can include aliphates, abietates, hydroxyalkanesulfonates, alkanesulfonates, dialkylsulfosuccinates, alkyldiphenyloxide disulfonates, straight-chain alkylbenzenesulfonates, branched alkylbenzenesulfonates, alkylnaphthalenesulfonates, alkylphenoxypolyoxy-ethylenepropylsulfonates, salts of polyoxyethylene alkylsulfonophenyl ethers, sodium N-methyl-N-oleyltaurates, monoamide disodium N-alkylsulfosuccinates, petroleum sulfonates, sulfated castor oil, sulfated tallow oil, salts of sulfuric esters of aliphatic alkylester, salts of alkylsulfuric esters, sulfuric esters of polyoxy-ethylene alkylethers, salts of sulfuric esters of aliphatic monoglucerides, salts of sulfuric esters of polyoxyethylenealkylphenylethers, salts of sulfuric esters of polyoxyethylenestyrylphenylethers, salts of alkylphosphoric esters, salts of phosphoric esters of polyoxyethylenealkylethers, salts of phosphoric esters of polyoxyethylenealkylphenylethers, partially saponified compounds of styrene-maleic anhydride copolymers, partially saponified compounds of olefin-maleic anhydride copolymers, and naphthalenesulfonateformalin condensates. Alkyldiphenyloxide disulfonates (such as sodium dodecyl phenoxy benzene disulfonates), alkylated naphthalene sulfonic acids, sulfonated alkyl diphenyl oxides, and methylene dinaphthalene sulfonic acids) are particularly useful as the primary anionic surfactant. Such surfactants can be obtained from various suppliers as described in McCutcheon's Emulsifiers & Detergents, 2007 Edition.

Particular examples of useful anionic surfactants include, but are not limited to, sodium dodecylphenoxyoxybenzene disulfonate, the sodium salt of alkylated naphthalenesulfonate, disodium methylene-dinaphthalene disulfonate, sodium dodecylbenzenesulfonate, sulfonated alkyl-diphenyloxide, ammonium or potassium perfluoroalkylsulfonate and sodium dioctylsulfosuccinate. The one or more anionic surfactants can generally be present in an amount of at least 1 wt % (% solids).

The aqueous liquid may optionally include one or more nonionic surfactants. Particularly useful nonionic surfactants include MAZOL PG031-K (a triglycerol monooleate, TWEEN 80 (a sorbitan derivative), PLURONIC L62LF (a block copolymer of propylene oxide and ethylene oxide), and ZONYL FSN (a fluorocarbon), and/or a nonionic surfactant for successfully coating the processing solution onto the printing plate surface, such as a nonionic polyglycol. These nonionic surfactants can be present in an amount of up to 10 wt %, but usually at less than 2 wt %.

EXAMPLES

Examples 1 and 2

In these comparative examples, Presstek PEARLDRY waterless plates were imaged on a Kodak MAGNUS image setter at a power of 249 $mJcm^{-2}$ (21 W laser power, 211 rpm drum speed) and were automatically cleaned on a Presstek WPP85/SC850 plate washer, manufactured by NES Worldwide Inc. (Westfield, Mass.). In this machine, the plates are cleaned with warm tap water (~35° C.) by means of rotary scrub rollers. The process speed is 0.8 m/min, and the brush speed is 350 rpm.

A plate was also cleaned in an additional, second manual step by wiping it with a cotton cloth saturated with the PEARLDRY plate cleaner manufactured by Varn International Co. (UK). This plate cleaner is a high-VOC product containing about 80% isopropanol and 20% of petroleum naphtha, which is not suitable for use in automatic plate cleaning devices.

Analytical work was carried out on the exposed areas of the cleaned plates to evaluate the impact of different cleaning procedures on their surface properties and potential effect on ink receptivity. The evaluation procedure included study of surface wettability by contact-angle measurements with different fluids and determination of the near-surface chemistry using X-rays photoelectron spectroscopy (XPS) analysis.

Static contact-angle measurements were performed on the OCA 20 drop shape analysis instrument manufactured by DataPhysics Instruments Gmbh (Filderstadt™, Germany). Contact-angle measurements were carried out on the exposed areas of the plates using water and methylene iodide, which represent fluids of extreme polarities. Water gives an indication of the surface wettability by mainly polar fluids while methylene iodide provides information on the tendency of the surface to interact with non-polar fluids. It expected that the latter is more representative of dry inks whose vehicles are mainly non-polar solvent.

The X-ray photoelectron spectroscopy (XPS) analysis was done on a VG ESCALab 250 instrument manufactured by Thermo Scientific (Waltham, Mass.). A monochromatic Al Kα X-ray radiation source was used at a spatial resolution of 250 μm and energy resolution of 0.5 eV.

XPS is a near-surface sensitive technique that provides chemical and atomic information on the most external layers of a material (three to four monolayers which correspond to a depth of analysis in the order of 0.6 nm). The XPS study provides information on the amount of residual silicone left in the near surface of the image areas of the plates after each cleaning procedure. The only XPS data reported are calculated values of silicon to carbon atoms (Si/C atomic ratio) measured on the surfaces. This parameter is a good indicator of the amount of silicone contamination present on the image or exposed areas of the plates.

The analytical work first involved reference samples consisting of an untouched sample of the polyester substrate and the top silicone oleophobic layer used in the PEARLDRY plate construction. The substrate sample was a 50 μm white polyester film sold by DuPont Teijin Films (Hopewell, Va.) labeled MELINEX 927W. The oleophobic silicone top layer of the plate member is described in earlier patents (e.g., U.S. Pat. No. 5,212,048). The values measured on these reference samples are showed in the following table, which illustrates the wide differences in surface properties of these two materials.

| | Melinex 927W | Silicone |
|---|---|---|
| Water contact angle (°) | 64 ± 1 | 107 ± 0.3 |
| Methylene iodide contact angle (°) | 27.5 ± 0.8 | 91.0 ± 0.5 |
| Si/C atomic ratio (XPS analysis) | 0.0 | 0.5 |

The next table shows the results of the surface study of the exposed areas of a plate that was cleaned in only one step on the automatic washer (Example 1) and a plate that was cleaned in a two-step procedure comprising automatic washer and a manual cleaning with the Varn PEARLDRY plate cleaner (Example 2).

| | Example 1 | Example 2 |
|---|---|---|
| Secondary Cleaning | None | Varn PEARLDRY Plate Cleaner |
| Water contact angle (°) | 101.6 ± 0.5 | 85 ± 2 |
| Methylene iodide contact angle (°) | 68.5 ± 0.9 | 56 ± 1 |
| Si/C atomic ratio (XPS analysis) | 0.155 | 0.058 |

The analytical results show that cleaning with water leaves a printing surface relatively rich in silicone which, as a consequence, exhibits poor interaction with both polar and non-polar fluids. Therefore, the printing surface displays silicone-like oleophobic and hydrophobic behavior. Without being bound by any specific theory or mechanism, it is believed that the silicone residue may represent the product of thermal decomposition, from the silicone top-layer of the plate, produced by the high heat generated during the imaging process. The XPS analysis shows that the silicone contamination is present as a thin layer embedded or intermixed with the rough polyester substrate. Removal of this type of residue would be difficult with an only-water cleaning.

Example 2 shows that that additional cleaning with the solvent-based product leads to a considerable removal of the silicone residue left in the water cleaning step. This is evidenced by the reduction in the Si/C near-surface atomic ratio and more important by the enhanced wettability of the image areas of the plate.

Plate samples were mounted on a Koenig and Bauer RAPIDA 74G waterless press (KBA North America, Dallas, Tex.) and printed on coated stock, using SAHARA CLASSICURE Waterless Ink, UV Curing (Classic Colours Ltd, Reading, England), and a compressible blanket. The roll-up of the plates with only water cleaning took at least four times longer than that of the plate that has the additional cleaning with the Varn Plate cleaner. The latter inks up satisfactorily within 40 paper sheets.

Examples 3-6

In these examples, Presstek PEARLDRY waterless plates were imaged on a Presstek COMPASS 8030 image setter at a power of 240 $mJcm^{-2}$. Cleaning of the plates occurred in three steps: (a) machine cleaning on a KP 650/860 S-CH plate cleaner from Konings (Viersen, Germany), (b) wiping of the surface with a cotton cloth saturated with oils or an oil-water suspension, and (c) wiping of the surface with a water-soaked cotton cloth to remove the excess oil. In the Konings plate washer the plates are cleaned with water warm (32° C.) with the help of two roller brushes, which rotate and move up and down continuously. Examples 3 and 4 are comparative examples.

Oils that are typically used as vehicles in low-VOC vegetable oil-based inks are suitable for the second cleaning step. Examples include soybean oil, linseed oil, canola oil, palm oil, rapeseed oil, sunflower seed oil, peanut oil, cottonseed oil, coconut oil, corn oil, grape seed oil and olive oil etc. In the present study, plate samples were cleaned in a second step using soybean oil supplied by Spectrum Chemicals Corp. (Gardena, Calif.).

The results of the analytical evaluation for the image areas of plate examples cleaned according to the procedure described above are given in the below table. The plates cleaned with a single machine step and using only water in the second step are included for purposes of comparison.

| | Example 3 | Example 4 | Example 5 | Example 6 |
|---|---|---|---|---|
| Step (b) Cleaning | None | Water | 100% oil | 5% oil-water suspension |
| Water contact angle (°) | 102 ± 1 | 95 ± 2 | 85 ± 2 | 88 ± 2 |
| Methylene iodide contact angle (°) | 75 ± 2 | 72 ± 1 | 40 ± 2 | 54 ± 2 |
| Si/C atomic ratio (XPS analysis) | 0.148 | | | 0.070 |

The analytical work confirms that plates cleaned only with water, even in a secondary cleaning step, display very poor wetting behavior which is expected to correlate to poor ink-up performance on press. Examples 5 and 6 show that the secondary cleaning with oil and the oil-water emulsion demonstrably improves the wettability of the image areas of these plate examples. These samples display wetting behavior and surface composition close or better to that of the plate described in Example 2. Without being bound by any particular theory or mechanism, it is believed that the oils appear to partially remove, displace and/or mask the silicone, forming an additional oily layer that interacts effectively with non-polar fluids such as inks.

The plates of Examples 5 and 6 are mounted on a Koenig and Bauer RAPIDA 74G waterless press (KBA North America, Dallas, Tex.) and are printed on coated stock, using SAHARA CLASSICURE Waterless Ink, UV Curing (Classic Colours Ltd, Reading, England), and a compressible blanket. Each plate ink ups satisfactorily within 40 paper sheets.

Examples 7-9

Presstek PEARLDRY waterless plates were imaged on a Presstek COMPASS 8030 image setter at a power of 240 $mJcm^{-2}$. Cleaning of the plates occurred in three steps: (a) machine cleaning on a KP 650/860 S-CH plate cleaner from Konings (Germany), (b) wiping of the surface with a cotton cloth saturated with the all-purpose household SIMPLE GREEN cleaner sold by Sunshine Makers, Inc. (California), and (c) wiping of the surface with a water-soaked cotton cloth to remove the surfactant and other water soluble additives present in the cleaning solution.

For Example 7, a plate was cleaned, in the second step of the cleaning procedure, with the concentrated SIMPLE GREEN product. However, this product produces excessive foaming which would preclude its utilization in typical plate-washer machines.

The foaming problem is addressed by the addition of a defoaming agent to the raw SIMPLE GREEN solution (Example 8). Suitable defoamers include modified silicone-based and silicone-free defoamers that are well known in the art. Examples of suitable defoamers suitable include the SURFYNOL DF products from Air Products and Chemicals Inc. (Allentown, Pa.) at the recommended addition levels. The plate of Example 8 was cleaned in Step (b) with a SIMPLE GREEN solution with an addition of 0.2% of the silicone-based SURFYNOL DF-62 defoamer. This defoaming agent mixed very well with the commercial product giving a clear solution that did not exhibit any foaming problems.

Example 9 repeated the method of Example 8, but uses a SIMPLE GREEN solution diluted with water by 50%.

The results of the analytical evaluation for the image areas of plate examples cleaned according to this procedure are given in the following table.

| | Example 7 | Example 8 | Example 9 |
|---|---|---|---|
| Step (b) Cleaning Solution Composition | 100% SIMPLE GREEN | 98% SIMPLE GREEN 0.2% Surfynol SF62 | 50% water dilution 0.2% Surfynol SF62 |
| Water contact angle (°) | 84 ± 1 | 83 ± 1 | 89 ± 1 |
| Methylene iodide contact angle (°) | 61 ± 2 | 57 ± 1 | 63 ± 1 |
| Si/C atomic ratio (XPS analysis) | 0.056 | | 0.104 |

It was observed that the cleaning with the SIMPLE GREEN concentrate produces a surface with wetting behavior and surface composition very close to that obtained with the high-VOC PEARLDRY plate cleaner of Example 2. Furthermore, the cleaning solution of Example 8 provides a low-VOC and low-foaming secondary cleaning solution that is easily and straightforwardly adapted for automatic plate cleaners. Example 9 shows that water dilution reduces the cleaning efficiency of the commercial product, but remains an improvement over Example 1.

The plate of Example 8 is mounted on a Koenig and Bauer RAPIDA 74G waterless press (KBA North America, Dallas, Tex.) and is printed on coated stock, using SAHARA CLASSICURE Waterless Ink, UV Curing (Classic Colours Ltd, Reading, England), and a compressible blanket. Each plate inks up satisfactorily within 40 paper sheets.

Examples 10-12

Presstek PEARLDRY waterless plates were imaged on a Presstek COMPASS 8030 image setter at a power of 240 $mJcm^{-2}$. Cleaning of the plates occurred in three steps: (a) machine cleaning on a KP 650/860 S-CH plate cleaner from Konings (Germany), (b) wiping of the surface with a cotton cloth saturated with in-house made solutions based on butylcellusolve, and (c) wiping of the surface with a water-soaked cotton cloth to remove the excess cleaning solution.

Ethylene glycol monobutyl ether, sold commercially as butyl cellosolve, is one of the solvents used in the SIMPLE GREEN household cleaner. In the following examples, the machine cleaned plates were cleaned in a second step with butyl cellosolve-water solutions made with a 99% purity butyl cellosolve solvent supplied by Sigma-Aldrich (St. Louis, Mo.).

The plate of Example 10 was cleaned with a 6% butyl cellosolve solution and the plates of Examples 11 and 12 were cleaned with solutions containing 6% butyl cellosolve plus surfactant and defoamer additives. Low to moderate foaming surfactants recommended for household cleaner and degreaser applications are suitable for this work. Examples of these surfactants are Naxan ABL, Naxan 220, Naxan UBL, and Naxan BFL, which are supplied by Nease Corporation (Cincinnati, Ohio). These are sodium salts of naphthalene and alkyl-modified naphthalene sulfonates.

The results of the analytical evaluation for the image areas of plate examples cleaned according to this procedure are given in the following table.

| | Example 10 | Example 11 | Example 12 |
|---|---|---|---|
| Step (b) Cleaning solution Composition | 6% butyl cellosolve 94% water | 6% butyl cellosolve 4% Naxan ABL 90% water | 6% butyl cellosolve 4% Naxan ABL 0.2% Surfynol SF62 88.8% water |
| Water contact angle (°) | 91 ± 1 | 82 ± 1 | 85 ± 2 |
| Methylene iodide contact angle (°) | 66 ± 1 | 62 ± 2 | 60 ± 2 |
| Si/C atomic ratio (XPS analysis) | 0.102 | | |

The results show that the cleaning efficacy of the solution containing only the butyl cellosolve solvent (Example 10) is not as good as that of the SIMPLE GREEN product (Examples 7 and 8). However, the cleaning performance is slightly improved by the addition of the surfactant in Examples 11 and 12. The cleaning solution of Example 12 is a low-VOC and low-foaming secondary cleaning solution that can be used in automatic plate cleaners.

The plate of Example 12 is mounted on a Koenig and Bauer RAPIDA 74G waterless press (KBA North America, Dallas, Tex.) and printed on coated stock, using SAHARA CLASSICURE Waterless Ink, UV Curing (Classic Colours Ltd, Reading, England), and a compressible blanket. Each plate inks up satisfactorily within 40 paper sheets.

Examples 13-14

Presstek PEARLDRY waterless plates were imaged on a Presstek COMPASS 8030 image setter at a power of 240 $mJcm^{-2}$. Cleaning of the plates occurred in three steps: (a) machine cleaning on a KP 650/860 S-CH plate cleaner from Konings (Germany), (b) wiping of the surface with a cotton cloth saturated with in-house made solutions based on D-limonene, and (c) wiping of the surface with a water-soaked cotton cloth to remove the excess cleaning solution.

D-limonene is a naturally-derived solvent that is considered an excellent replacement for solvents that may pose flammability, toxicity, and waste-disposal problems. It is a cyclic terpene that is the major component of the oils extracted from the rinds of citrus fruits. It is considered a combustible liquid in its concentrated form; however, it is safe and widely used in environmentally friendly commercial products at dilutions of 5% to 25% in water.

Work conducted in the art of hard surface cleaners (see, e.g., U.S. Pat. No. 5,856,289) indicates that the addition of D-limonene to the SIMPLE GREEN product produces homogeneous mixtures with highly reduced foaming and effective cleaning performance for hard surface applications. In the following examples, D-limonene available from MP Biomedicals, LLC (Solon, Ohio) is added to SIMPLE GREEN product solutions to reduce foaming and to improve cleaning action. Example 13 involves a PEARLDRY plate that was cleaned with a solution of the SIMPLE GREEN concentrate with a 5% addition of D-limonene. The plate of Example 14 was cleaned with a diluted solution containing 25% of the concentrated SIMPLE GREEN and 5% D-limonene.

| | Example 13 | Example 14 |
|---|---|---|
| Step (b) Cleaning solution Composition | 95% SIMPLE GREEN 5% D-limonene | 25% SIMPLE GREEN 5% D-limonene 70% water |
| Water contact angle (°) | 81.5 ± 0.5 | 80 ± 1 |

-continued

| | Example 13 | Example 14 |
|---|---|---|
| Methylene iodide contact angle (°) | 60.2 ± 0.8 | 61 ± 1 |
| Si/C atomic ratio (XPS analysis) | 0.066 | 0.068 |

The plates of these examples exhibit wetting performance comparable to that of the plate cleaned with the 100% SIMPLE GREEN solution, so the addition of D-limonene does not provide any improvement in terms of the cleaning efficiency of the concentrated product (e.g., as compared with Example 7). However, the addition of D-limonene reduced foam formation on the SIMPLE GREEN product in both the concentrated and diluted form. The cleaning solution of these examples provides low-VOC and low-foaming secondary cleaning solutions that are easily and straightforwardly adapted for applications in automatic plate cleaners.

The plates of Examples 13 and 14 are mounted on a Koenig and Bauer RAPIDA 74G waterless press (KBA North America, Dallas, Tex.) and are printed on coated stock, using SAHARA CLASSICURE Waterless Ink, UV Curing (Classic Colours Ltd, Reading, England), and a compressible blanket. Each plate inks up satisfactorily within 40 paper sheets.

Examples 15 and 16

Presstek PEARLDRY waterless plates were imaged on a Kodak MAGNUS image setter at a power of 249 $mJcm^{-2}$, and for Example 15, they were automatically cleaned in a Presstek WPP85/SC850 plate washer, using warm tap water as described in Example 1 above. For Example 16, the unheated second developing section of the washer was filled with 20 liters of a 50% solution of SIMPLE GREEN household cleaner in water, and imaged plate samples were processed thereafter through the washer. Example 15 is a comparative example.

The plate samples were mounted on a Koenig and Bauer RAPIDA 74G waterless press (KBA North America, Dallas, Tex.) and printed on coated stock, using UV Aqualess PA Process Series ink (Toyo Ink America, Addison, Ill.), and a compressible blanket. The plate of Example 15 took 200 to 400 paper sheets to ink up satisfactorily. The plate of Example 16 took 100 sheets.

Analytical work carried out in connection with Example 16 showed that the additional cleaning cycle with the diluted SIMPLE GREEN solution leads to removal of about 30% of the residual silicone and gives a surface with improved wetting behavior.

| | Example 15 | Example 16 |
|---|---|---|
| Water contact angle (°) | 101.6 ± 0.5 | 92 ± 1 |
| Methylene iodide contact angle (°) | 68.5 ± 0.9 | 61 ± 1 |
| Si/C atomic ratio (XPS analysis) | 0.155 | 0.109 |

Examples 17-19

Presstek PEARLDRY waterless plates were imaged on a Presstek COMPASS 8030 image setter at a power of 240 $mJcm^{-2}$. Cleaning of the plates occurred in three steps: (a) machine cleaning on a KP 650/860 S-CH plate cleaner from Konings (Germany), (b) wiping of the surface with a cotton cloth saturated with a stable soybean oil emulsion, and (c) wiping of the surface with a water-soaked cotton cloth to remove the excess cleaning emulsion.

Stable emulsions of soybean oil in water were prepared with LUMUSOLVE VOE-100 emulsifier manufactured by Lambent Technologies (Gurnee, Ill.). This emulsifier is specifically intended for the emulsification of canola and soybean oils in water. Emulsions were prepared following the manufacturer's recommendations. First, an oil-emulsifier concentrate was made by adding 15% w/w of emulsifier to the soybean oil, and then the concentrate was diluted by adding water (10:1 ratio) with continuous agitation. Acceptable concentrations of emulsifier for the present application range from 10% to 20% of the concentrate, and water dilution may be increased up to 20:1 as appropriate. This procedure yields stable soybean emulsions which do not show signs of separation after storage at room temperature for more than two weeks.

The following table shows the results of the analytical analysis of image areas of PEARLDRY plates cleaned with soybean oil emulsions prepared according to the procedure described above.

| | Example 17 | Example 18 | Example 19 |
|---|---|---|---|
| Step (b) soybean oil concentration in emulsion | 5% | 10% | 20% |
| Water contact angle (°) | 90 ± 2 | 88 ± 1 | 75 ± 2 |
| Methylene iodide contact angle (°) | 53 ± 1 | 46 ± 1 | 34 ± 2 |
| Si/C atomic ratio (XPS analysis) | 0.071 | 0.049 | 0.036 |

The analytical measurements indicate that secondary cleaning of the PEARLDRY plate image areas with these soybean oil emulsions enhances their wetting behavior and that there is considerable improvement with increasing soybean oil concentration. Consistent with these results, there is also a considerable reduction of the silicone residue measured on the surfaces. The cleaning method of Example 19 appears to provide more effective cleaning performance than that provided by the high-VOC Varn Plate cleaner described in Example 2. These are low-foaming emulsions that are suitable for use in automatic plate cleaners.

The plates of Examples 18 and 19 are mounted on a Koenig and Bauer RAPIDA 74G waterless press (KBA North America, Dallas, Tex.) and are printed on coated stock, using SAHARA CLASSICURE Waterless Ink, UV Curing (Classic Colours Ltd, Reading, England), and a compressible blanket. Each plate inks up satisfactorily within 40 paper sheets.

Examples 20 and 21

Presstek PEARLDRY waterless plates were imaged on a Presstek COMPASS 8030 image setter at a power of 240 $mJcm^{-2}$. Cleaning of the plates occurred in three steps: (a) machine cleaning on a KP 650/860 S-CH plate cleaner from Konings (Germany), (b) wiping of the surface with a cotton cloth saturated with a stable linseed oil emulsion, and (c) wiping of the surface with a water-soaked cotton cloth to remove the excess cleaning emulsion.

Linseed oil-in-water emulsions were prepared with LUMUSOLVE VOE 100 emulsifier according to the procedure described in Examples 17-19 with soybean oil. This procedure yields partially stable linseed oil emulsions that display very slight signs of separation after storage for about three days; however, the emulsions quickly recover a homogeneous appearance with mild agitation.

Analytical results of the evaluation of PEARLDRY plate image areas cleaned with emulsions having different oil concentrations are given in the following table.

| | Example 20 | Example 21 |
|---|---|---|
| Step (b) Linseed oil concentration | 10% | 20% |
| Water contact angle (°) | 78 ± 2 | 68 ± 1 |
| Methylene iodide contact angle (°) | 45 ± 1 | 39 ± 1 |
| Si/C atomic ratio (XPS analysis) | 0.048 | 0.034 |

The results indicate that the cleaning performance of the linseed oil-in-water emulsions is comparable to that of the soybean oil emulsions and that there is also considerable improvement with increasing oil concentration.

Examples 22 and 23

Presstek PEARLDRY waterless plates were imaged on a Presstek COMPASS 8030 image setter at a power of 240 $mJcm^{-2}$. Cleaning of the plates occurred in three steps: (a) machine cleaning on a KP 650/860 S-CH plate cleaner from Konings (Germany), (b) wiping of the surface with a cotton cloth saturated with a D-limonene emulsion, and (c) wiping of the surface with a water-soaked cotton cloth to remove the excess cleaning emulsion.

D-limonene was emulsified with DeMULS DLN-2314 emulsifier manufactured by DeForest Enterprises, Inc. (Boca Raton, Fla.). This is a biodegradable emulsifier specifically manufactured for the preparation of stable D-limonene emulsions. A stable D-limonene-in-water emulsion containing 20% w/w D-limonene and 22% w/w of DeMULS DLN 2314 was prepared following the procedure recommended by the manufacturer. First, the D-limonene and emulsifier were mixed to form a clear solution. Second, half of the water was added and mixed thoroughly, and then the rest of the water was added slowly with agitation to form a clear solution. The procedure provided a stable suspension that did not show signs of separation after storage at room temperature for more than two weeks.

Emulsion compositions containing 5% or more (e.g., up to 40%) D-limonene are suitable for the plate cleaner application. Formulation variations are made according to the same procedure described above and keeping the same D-limonene/emulsifier ratio.

The following table shows the results obtained for a sample cleaned with the 20% D-limonene emulsion compared with a sample cleaned using the pure D-limonene product.

| | Example 22 | Example 23 |
|---|---|---|
| Step (b) D-limonene concentration | 20% emulsion | 100% D-limonene |
| Water contact angle (°) | 89 ± 2 | 78 ± 1 |
| Methylene iodide contact angle (°) | 58 ± 1 | 56 ± 1 |
| Si/C atomic ratio (XPS analysis) | 0.07 | |

The 20% D-limonene emulsion provides cleaning performance close to that of the concentrate SIMPLE GREEN product described in Examples 7 and 8. In addition, cleaning with this emulsion yields a plate surface with wetting behavior close to that obtained with the raw D-limonene. The cleaning solution of Example 22 is a low-foaming secondary cleaning solution that is straightforwardly adapted for automatic plate cleaners.

Although the present invention has been described with reference to specific details, it is not intended that such details should be regarded as limitations upon the scope of the invention, except as and to the extent that they are included in the accompanying claims.

The invention claimed is:

1. A method of printing with an ablation-type printing member having a silicone topmost layer, the method comprising the steps of:

(a) selectively exposing the printing member to imaging radiation so as to effect imagewise ablation of the imaging layer and consequent de-anchoring of the topmost layer to thereby create, on the printing member, an image region including ablation debris;

(b) without further exposure to imaging radiation, subjecting the printing member to a first cleaning liquid that is not a solvent for silicone to remove a portion of the ablation debris;

(c) following step (b), subjecting the printing member to a second cleaning liquid that comprises or consists essentially of a solvent for silicone, thereby creating an imagewise lithographic pattern on the printing member;

(d) following the removal step, applying a high-solids ink to the printing member; and (e) transferring the applied ink from the printing member to a recording medium, wherein neither first cleaning liquid nor the second cleaning liquid is ink.

2. The method of claim 1 further comprising repeating steps (d) and (e) a plurality of times to complete cleaning of the printing member before commencing printing, whereupon the ink adheres only to imaged portions of the printing member.

3. The method of claim 1 wherein the ink is a 100%-solids ink.

4. The method of claim 3 wherein the ink is a UV-curable ink.

5. The method of claim 4 wherein the ink consists essentially of pigment and acrylic monomers.

6. The method of claim 1 wherein the first cleaning liquid is an aqueous liquid containing no organic solvent.

7. The method of claim 6 wherein the first cleaning liquid is plain tap water.

8. The method of claim 1 wherein the second cleaning liquid consists essentially of an aqueous component and an organic component.

9. The method of claim 8 wherein the aqueous component itself consists essentially of water.

10. The method of claim 8 wherein the aqueous component represents no more than 95 wt % of the second cleaning fluid.

11. The method of claim 8 wherein the aqueous component represents no more than 80 wt % of the second cleaning fluid.

12. The method of claim 8 wherein the organic component comprises an alcohol.

13. The method of claim 12 wherein the alcohol is phenoxyethanol.

14. The method of claim 12 wherein the alcohol is 2-butoxyethanol (butyl cello solve).

15. The method of claim 12 wherein the alcohol is 2-ethoxyethanol.

16. The method of claim 8 wherein the organic component comprises an animal or vegetable oil.

17. The method of claim 8 wherein the organic component comprises a hydrocarbon solvent.

18. The method of claim 8 wherein the second cleaning liquid consists essentially of an animal or vegetable oil.

19. A method of imaging an ablation-type printing member having a silicone topmost layer, the method comprising the steps of:

(a) selectively exposing the printing member to imaging radiation so as to effect imagewise ablation of the imaging layer and consequent de-anchoring of the topmost layer to create, on the printing member, an image region including ablation debris;

(b) without further exposure to imaging radiation, subjecting the printing member to a first cleaning liquid that is not a solvent for silicone to remove a portion of the ablation debris;

and (c) following step (b), subjecting the printing member to a second cleaning liquid that comprises or consists essentially of a solvent for silicone, thereby creating an imagewise lithographic pattern on the printing member, wherein neither first cleaning liquid nor the second cleaning liquid is ink.

20. The method of claim 19 further comprising the steps of:

(d) following the removal step, applying a high-solids ink to the printing member;

(e) transferring the applied ink from the printing member to a recording medium; and (f) repeating steps (d) and (e) a plurality of times.

21. The method of claim 19 wherein the second cleaning liquid comprises a surfactant.

22. The method of claim 19 wherein the second cleaning liquid comprises a defoamer.

23. The method of claim 19 wherein the second cleaning liquid comprises D-limonene.

* * * * *